US005556216A

United States Patent [19]

Mayesh

[11] Patent Number: 5,556,216

[45] Date of Patent: Sep. 17, 1996

[54] SCAVENGING CAP APPLICATOR

[76] Inventor: Sol Mayesh, 32099 Box D Rd. 122, Visalia, Calif. 93291

[21] Appl. No.: 381,413

[22] Filed: Jan. 30, 1995

[51] Int. Cl.[6] ..... A46B 11/00

[52] U.S. Cl. ..... 401/127; 401/129

[58] Field of Search ..... 401/127, 129

[56] References Cited

U.S. PATENT DOCUMENTS

| | | | |
|---|---|---|---|
| 2,736,050 | 2/1956 | Lee | 401/122 |
| 5,096,320 | 3/1992 | Norman et al. | 401/127 |

FOREIGN PATENT DOCUMENTS

| | | | |
|---|---|---|---|
| 1395217 | 3/1965 | France | 401/127 |
| 1554842 | 1/1969 | France | 401/127 |
| 158330 | 3/1957 | Sweden | 401/127 |
| 442641 | 1/1968 | Switzerland | 401/127 |
| 447501 | 3/1968 | Switzerland | 401/127 |

*Primary Examiner*—Steven A. Bratlie

[57] ABSTRACT

A scavenging cap applicator including a cap, an applicator and multi-component stem inserted through the cap, the applicator engaging portions of the stem and being further susceptible to repositioning at a discrete extension from the cap, and a seal precluding liquid passage around the applicator stem. The applicator further comprises a brush or dauber and may be inserted to two or more extents of immersion within a liquid in an associated bottle and most particularly enables reaching the bottle bottom to gather final remnants of liquid therein.

1 Claim, 5 Drawing Sheets

SCAVENGING CAP APPLICATOR

BACKGROUND OF THE INVENTION

1. Field of the Invention

The present invention relates to cap applicators and more particularly pertains to applicators employed in conjunction with bottle-like fluid and paste containers and more particularly pertains to a scavenging cap applicator which may be employed to manually extract a maximal quantity of material from a bottle-like container.

2. Description of the Prior Art

The use of applicators held by bottle caps is known in the prior art. More specifically, cap mounted applicators heretofore devised and utilized for the purpose of extracting liquids and pastes from bottle-like containers are known to consist basically of familiar, expected, and obvious structural configurations, notwithstanding the myriad of designs encompassed by the crowded prior art which has been developed for the fulfillment of countless objectives and requirements.

The present invention is directed to improving devices for a scavenging cap applicator in a manner which is safe, secure, economical and aesthetically pleasing.

For example, U.S. Pat. No. 5,116,154 to Fulkerson discloses a spring-loaded bottle cap/applicator apparatus comprising a cap assembly, a brush, and a coil spring which bias the brush outwardly relative to the upper cap member when the cap member is not fully engaged with the bottle neck thereby permitting brush access to the bottle bottom independently of the state of cap engagement ranging from a tightened condition to a beginning of cap-bottle separation. The Fulkerson invention employs a spring bias technique for maintaining the applicator near the bottle bottom until removed, however the Fulkerson invention has no provision for controlling the immersion depth of the applicator thereby permitting the applicator portion to be immersed without regard to the fill state of the bottle. The present invention has an applicator which permits dual state control of the depth of immersion of the applicator.

In U.S. Pat. No. 4,961,664 to Simper a nail polish container having a moveable brush is disclosed comprising a brush applicator unit that is movably mounted on the cap unit of the container wherein the brush unit is moved by depressing a button on the cap wherein a stop holding the brush in a retracted or extended position may be included therein. The advantage of the Simper invention is in keeping the brush applicator clear of the nail polish until the cap is removed thereby preventing buildup of nail polish on the stem portion. The present invention comprises a manually positionable applicator stoppable at discrete positions ranging from a bottle bottom to top with the cap in a tightened state or loosened state except removal thereof. The present invention permits immersion of a portion of the applicator when the liquid or paste held in the bottle is at any level or fill.

In U.S. Pat. No. 5,061,103 to Walsh-Smith a mascara applicator is described. The Walsh-Smith invention comprises a container having a silicone wiper gland allowing ingress and egress of an applicator brush and an attached stem. The Walsh-Smith invention has no provision for scavenging a bottle-like container which may be filled with substantially low viscosity fluid. The present invention comprises a manually positionable applicator which enables removal of most material of a liquid or paste-like nature from a bottle-like container.

In U.S. Pat. No. 5,096,320 to Norman et al. an adjustable brush cap apparatus is disclosed for manually repositioning an included spring loaded plunger and attached brush to enable the brush to contact the floor of the container. A disadvantage in this prior art lies in a lack of provision for unattended maintenance of immersion of the applicator brush. The present invention comprises a lid mounted applicator susceptible to manual repositioning and unattended maintenance of immersion extents including touching the bottle bottom.

U.S. Pat. No. 5,052,837 to Iizuka et al. discloses a makeup liquid container with applicator. The disclosure teaches a makeup liquid container having an opening, a cap, an applicator and shaft fitting the container when the cap is affixed to the container, and an internal slider devised to scrape liquid makeup from the walls of the container during shaking or movement of the applicator. The disclosure makes no provision for adjustably inserting an applicator to control immersion in a liquid or paste-like reservoir. The present invention comprises an applicator mounted in a bottle cap having a manually adjustable depth of insertion of the applicator which may be employed to adjust the depth of immersion of the applicator within the liquid or paste thereheld.

In this respect, the scavenging cap applicator according to the present invention substantially departs from the conventional concepts and designs of the prior art, and in doing so provides an apparatus primarily developed for the purpose of extraction of a maximal useful quantity of the contents of a bottle-like container using an applicator.

Therefore, it can be appreciated that there exists a continuing need for new and improved scavenging cap applicators which can be used to controllably extract a maximal quantity of liquid or paste from a bottle-like container. In this regard, the present invention substantially fulfills this need.

As illustrated by the background art, efforts are continuously being made in an attempt to improve applicators held by bottle caps. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of bottle cap applicators now present in the prior art, the present invention provides an improved scavenging cap applicator construction wherein the same can be utilized for extracting a maximal quantity of liquid or paste from a bottle-like container. As such, the general purpose of the present invention, which will be described subsequently in greater detail, is to provide a new and improved scavenging cap applicator apparatus and method which has all the advantages of the prior art and none of the disadvantages.

The invention is defined by the appended claims with the specific embodiment shown in the attached drawings. For the purpose of summarizing the invention, the invention may be incorporated into a cap threadedly engaging a bottle-like container wherein the cap has a central through hole and an elongated applicator stem disposed therethrough, and furthermore the cap has a seal ring disposed therein to liquid loss while permitting rotational and translational movement of the applicator stem within the cap. The applicator stem has a brushlike applicator affixed to a free end thereof and an cylindrical actuator disposed at an opposing free end thereof. A portion of the stem is threaded and engages a mating portion of the cap within the through hole. The applicator may be positioned at any depth within the liquid by applying translational force to the actuator of the applicator stem thereby affecting extended repositioning of the applicator by rotated advancement.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto. Inasmuch as the foregoing has outlined rather broadly the more pertinent and important features of the present invention in order that the detailed description of the invention that follows may be better understood so that the present invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

It is therefore an object of the present invention to provide an improved scavenging cap applicator which providing a means for extracting a maximal quantity of liquid or paste-like material from a bottle-like container.

It is another object of the present invention to provide new and improved scavenging cap applicator which may be easily and efficiently manufactured and marketed.

Still another object of the present invention is to provide a new and improved scavenging cap applicator which provides in the apparatuses and methods of the prior art some of the advantages thereof, while simultaneously overcoming some of the disadvantages normally associated therewith.

Yet another object of the present invention is to provide a new and improved scavenging cap applicator having a discretely adjustable applicator immersed depth.

Even still another object of the present invention is to provide a new and improved scavenging cap applicator providing single handed selection of the depth of the immersion of the applicator within the liquid or paste-like material held within a bottle-like container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
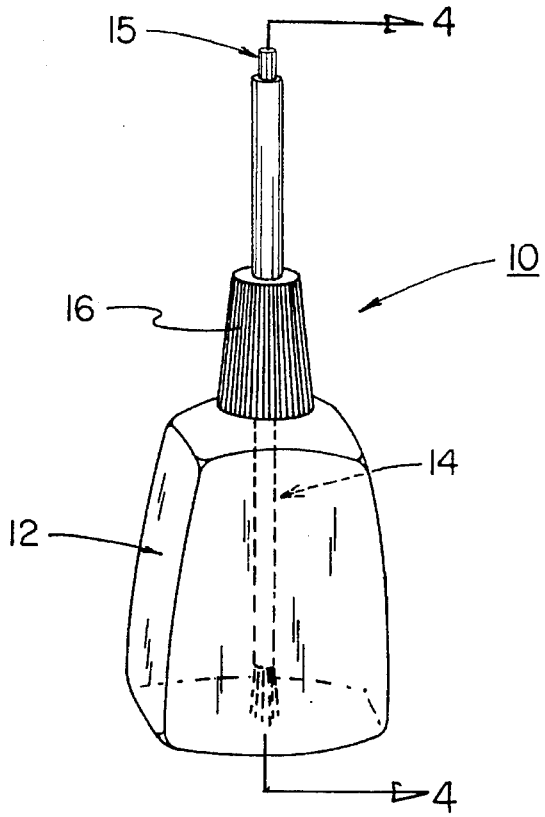
FIG. 1 is a perspective view of the scavenging cap applicator showing the cap member threadedly coupled to the container and the applicator and stem assembly in a retracted position.

With reference now to the drawings, and in particular to FIG. 1 thereof, a new and improved scavenging cap applicator embodying the principles and concepts of the present invention and generally designated by the reference numeral 10 will be described.

From an overview standpoint, the scavenging cap applicator 10 is adapted for use with a liquid or paste filled bottle-like container 12. See FIG. 1. The scavenging cap applicator 10 comprises an applicator and stem assembly 14 disposed within cap member 16 wherein cap member 16 is threadedly affixed to container 12 during storage and is threadedly disengaged therefrom for use. As the level of liquid or paste is extracted from the bottle-like container 12 during use, or otherwise at the discretion of the user, the applicator and stem assembly 14 may be activated by short duration application of manual force to actuator 15 thereby extending the applicator further within the bottle-like container until latching engagement of the stem assembly 14 with portions of cap member 16 is achieved. In latching engagement of the applicator and stem assembly 14 with portions of cap member 16 the applicator and stem assembly 14 maintains the applicator and some stem portion in an extended position thereby maintaining the applicator 20 proximal to the bottom 21 of bottle-like container 12. See FIG. 10. A second short duration application of manual force to actuator 15 disengages the stem assembly 14 from portions of cap member 16 whereby applicator 20 is returned to a retracted position.

Figure 2:
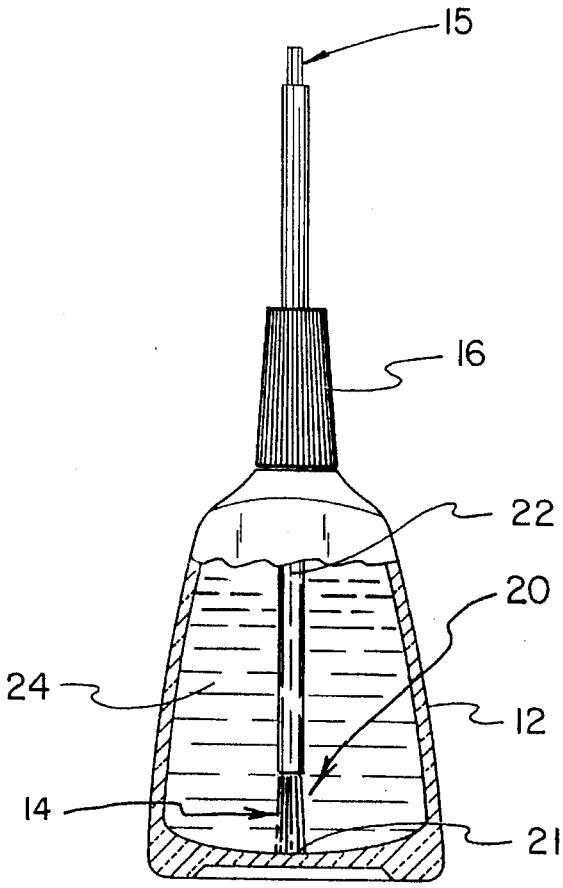
FIG. 2 is a fragmentary side sectional or cutaway view of the scavenging cap applicator in a substantially maximal immersion position with the cap member threadedly coupled to the container and the applicator and stem assembly in a retracted position.
Figure 3:
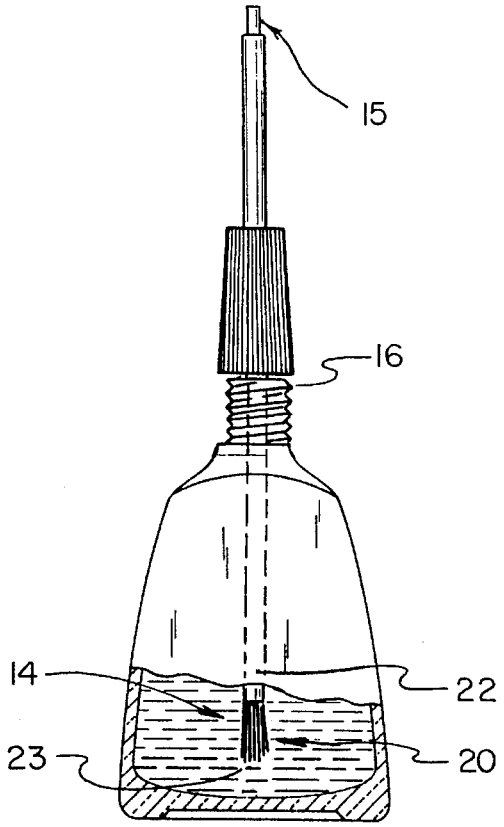
FIG. 3 is a fragmentary side sectional or cutaway view of the scavenging cap applicator in a substantially minimal immersion position with the cap member disengaged from the container and in mated contact therewith and the applicator and stem assembly in a retracted position.

More specifically, it will be noted that the scavenging cap applicator 10 comprises a cap 16, an actuator 15, and an applicator assembly 14. Applicator and stem assembly 14 comprises an applicator 20 affixed to a stem member 22. Applicator 20 generally comprises a group of bristles of a polymeric foam piece affixed at an end thereof to a free end of stem member 22. Applicator 20 is generally initially extended a distance into liquid or paste-like material 24 when cap member 16 is threadedly affixed to container 12 wherein such extension results in a degree of immersion as experienced in a high level of liquid or paste-like material 24 with the corresponding retracted applicator 20 position as shown in FIG. 2, or as experienced in a low level of liquid or paste-like material 23 when cap member 16 is threadedly disengaged from the container 12 with the corresponding retracted applicator position as shown in FIG. 3.

Figure 4:
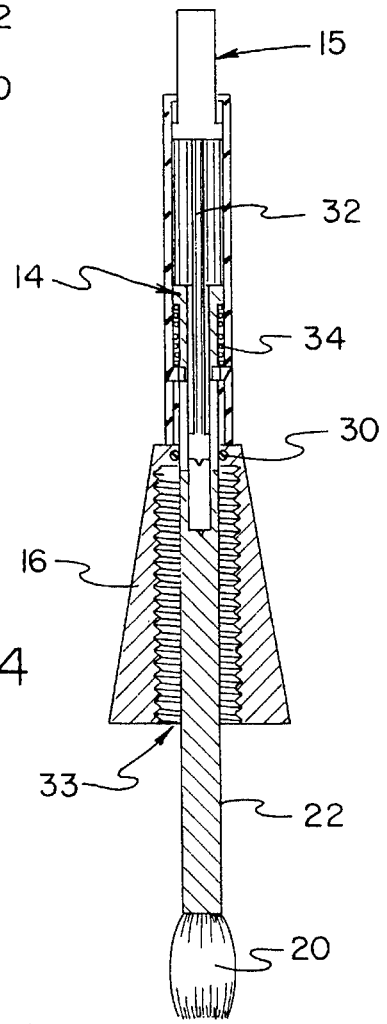
FIG. 4 is a side sectional view of a scavenging cap applicator taken substantially upon the plane indicated by the section line 4—4 of FIG. 1 showing the applicator, applicator stem components, seal and cap.
Figure 5:
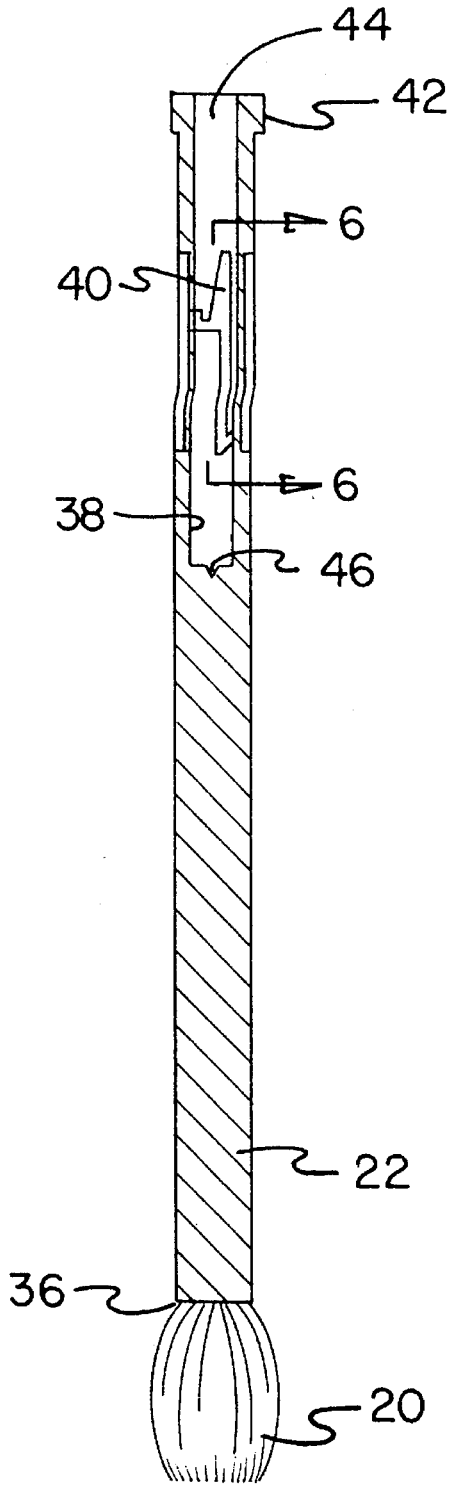
FIG. 5 is a side sectional view of a scavenging cap applicator showing a stem portion in section defined by a single plane containing the cap axis of symmetry.

Cap 16, applicator and stem assembly 14, actuator 15, and a seal 30 share a common axis and form the basic components of invention. See FIG. 4. Applicator and assembly 14 comprise a stem member 22, a driver pin 32, and spring 34. Stem member 22 comprises an elongated cylinder having an applicator engagement portion 36, a drive pin receiver cavity 38 bounded by a sidewall, a plurality of latch outwardly facing slots 40 formed on the sidewall, and a spring engagement portion 42. See FIG. 5.

Figure 6:
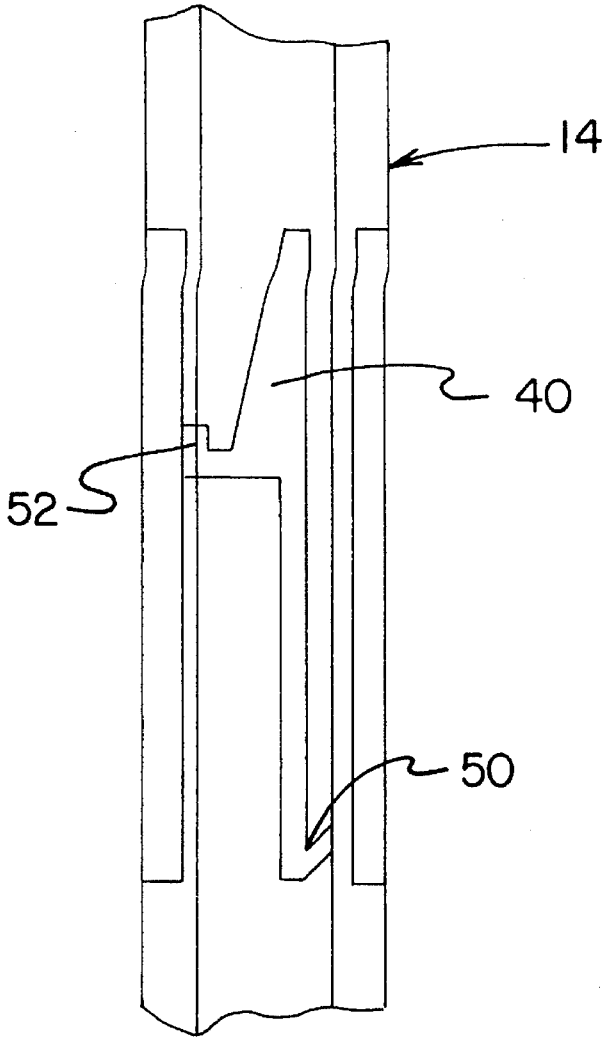
FIG. 6 is a fragmentary side sectional view of a scavenging cap applicator taken substantially upon the plane indicated by the section line 6—6 of FIG. 5.
Figure 7:
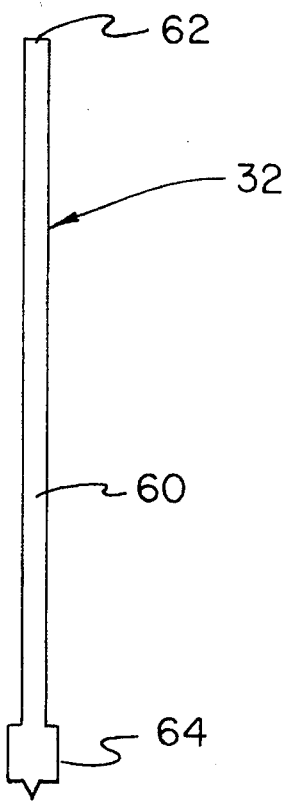
FIG. 7 is a side elevational view of a scavenging cap applicator showing a driver pin.

Applicator engagement portion 36 comprises a crimp, adhesive or other system for permanently affixing the applicator 20 to stem 22. Drive pin receiver cavity 38 comprises an elongated right cylindrical cavity having a uniform diameter throughout and terminating in a driver pin engagement surface 46. Driver pin engagement surface 46 comprises a surface complementary to a mating surface of driver pin 32 and exhibits a centrosymmetric right triangular recessed surface portion which driver pin 32 engages to impart ratcheting rotation to stem member 22 whenever actuator 15 is depressed. Latch slots 40 penetrate in part the sidewall of driver pin receiver cavity 38 and further comprise repeating patterned slots each having a step 50 and flat landing 52 formed therein corresponding to respective retracted and extended positions of stem member 22. See FIG. 6. Driver pin 32 comprises an elongated pin-like member 60 having a substantially cylindrical shape and furthermore having a uniform diameter at a first free end 62 thereof and an enlarged diameter at a second free end 64 thereof. First free end 62 is permanently affixed to actuator 15. Second free end 64 has a centrosymmetric right triangular raised surface portion which engages the complementary driver pin engagement surface 46.

Figure 8:
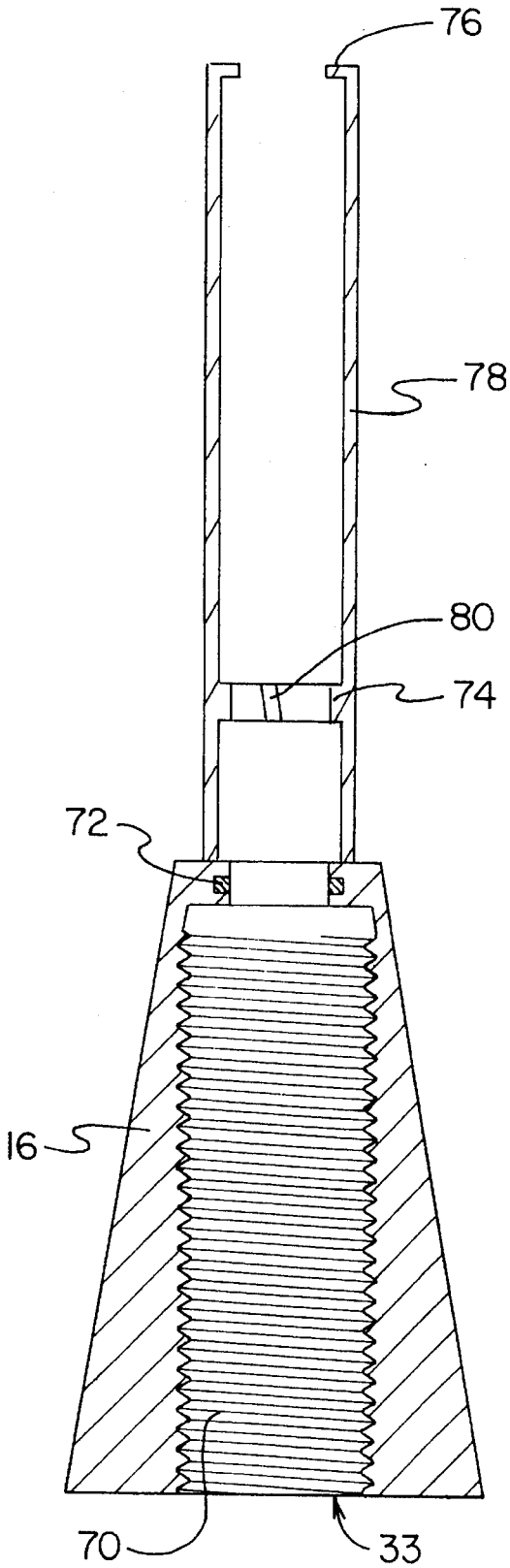
FIG. 8 is a fragmentary perspective view of a scavenging cap applicator showing a cap member.

Cap 16 comprises a substantially polymeric structure having an axially aligned through hole 33 disposed therein. See FIG. 8. Through hole 33 comprises a threaded portion 70. Also provided is a seal receptacle 72, raised and inwardly projected internal latch portions 74, a retainer ring 76, and an elongated tube portion 78. See FIG. 8. Threaded portion 70 comprises a generally coarse internal taper thread of common usage in sealing bottle-like containers. Seal receptacle 72 comprises an internal circumferential groove providing seating for seal 30. Seal receptacle 72 is slightly oversize when compared to the dimensions of seal 30 thereby providing for some expansion of seal 30 thereinto for the purpose of producing a specific engagement of stem 22 and seal 30. Raised internal latch portions 74 comprise a plurality of raised regions 80 which engage latch slots 40 thereby permitting latching extension and retraction of the applicator and stem assembly 14 through short duration application of manual force.

Figure 9:
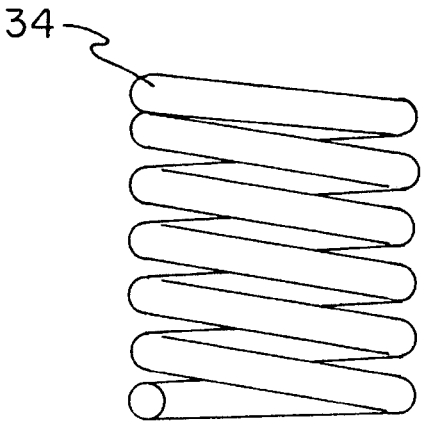
FIG. 9 is a side elevational view of a scavenging cap applicator showing a helical compression spring member.

Spring 34 comprises a helical compression spring as shown in FIG. 9 and provides restorative energy to retract applicator and stem assembly 14.

In an alternate embodiment, the scavenging cap applicator 10 may be employed in conjunction with a bottle-like container having a rounded interior bottom portion which permits remnant liquids to move to a central location under the influence of gravity thereby reducing waste upon exhausting all accessible liquid therein. The bottle-like container may be initially manufactured with a rounded interior bottom or in a process involving spinning uncured liquid-like epoxy material about a vertical axis and permitting the epoxy to cure to a hard state during the spin process whereby a depressed central interior portion is resultant.

Figure 10:
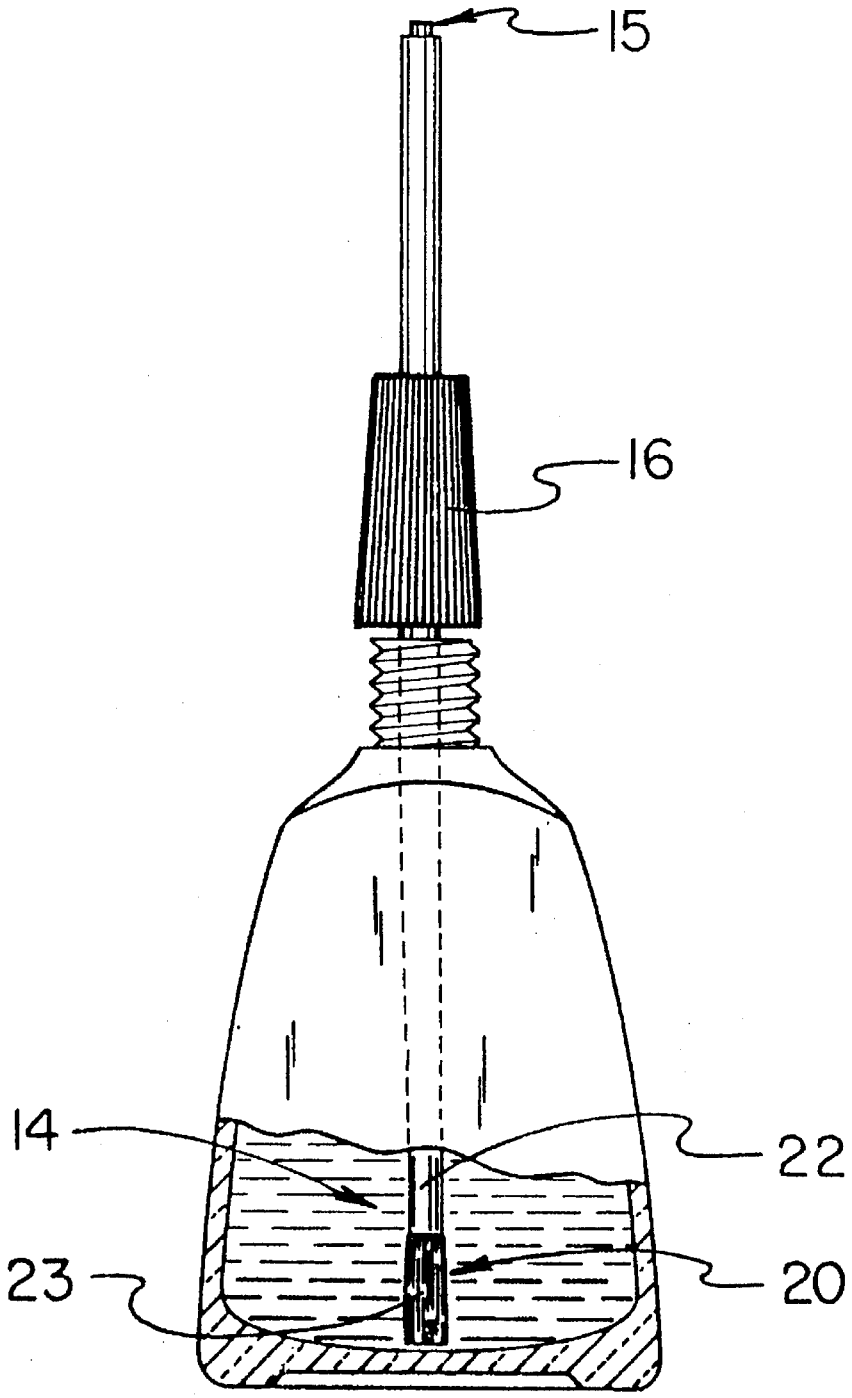
FIG. 10 is a fragmentary side sectional or cutaway view of the scavenging cap applicator in a substantially maximal immersion position with the cap member disengaged from the container and proximal thereto and the applicator and stem assembly in a extended position.

Thus, as shown in FIG. 3, the cap applicator is placed in a substantially minimal immersion position with the cap member 16 threadedly disengaged from the container 12 and in mated contact therewith and the applicator and stem assembly 14 in a retracted position. However, when actuator 15 is depressed through short duration application of manual force as shown in FIG. 10, the cap applicator is placed in a substantially maximal immersion position with the applicator and stem assembly now in an extended position. The extended position enables removal of most material of a liquid or paste-like nature from the container. The stem assembly in combination with the actuator can also be formed to allow a plurality of extendable positions to be realized for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The present invention, the new and improved scavenging cap applicator, comprised of a plurality of components. Such components are individually configured and correlated with respect to each other so as to attain the desired objective.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new scavenging cap assembly for extracting liquids from an existing bottle-like container comprising:

an applicator and stem assembly, wherein the applicator and stem assembly comprises a brush-like applicator member and an elongate cylindrical stem member having an applicator engagement portion, a drive pin receiver cavity bounded by a sidewall, a plurality of outwardly facing slots formed on the sidewall and a spring engagement portion;

an actuator for transferring manual force motion to said applicator and stem assembly;

a driver pin affixed to said actuator, wherein said driver pin has an elongate body terminating in an applicator and stem assembly engagement means whereby axial translation of said driver pin is converted to rotation of said applicator and stem assembly wherein said driver pin has a cylindrical shape and furthermore having a uniform diameter at a first free end thereof affixed to said actuator and an enlarged diameter at a second end thereof having a centrosymmetric right triangle raised surface portion, wherein said engagement means comprises a ratchet whereby said ratchet converts translational motion of said drive pin to rotational motion of the applicator and stem assembly and further provides latching of the applicator and stem assembly in an extended and retracted thereof, wherein said drive pin receiver cavity comprises an elongate right cylindrical cavity having a uniform diameter throughout and terminating in a driver pin engagement surface including a centrosymmetric right triangle recessed portion engaging said driver pin;

wherein said applicator engagement portion comprises a crimp for permanently affixing said applicator to said stem member;

a cap member threadedly engaging said bottle-like container wherein said cap member has said applicator and stem assembly disposed within a centrally positioned through hole and furthermore said applicator and stem assembly is susceptible to selectable manual latching in a retracted and extended disposition permitting engagement of said applicator with a liquid contained within said bottle-like container;

a seal member affixed to said cap member and slidably engaging portions of the applicator and stem assembly, wherein said seal member comprises a resilient washer-like gasket disposed within an internally formed slot of said cap member and furthermore said gasket fills said slot and slidably engages said stem member thereby precluding passage of liquid along said applicator stem past said seal member outwardly from said bottle-like container;

a spring member affixed to said cap member and slidably engaging portions of the applicator and stem assembly;

wherein a stem member has an actuator portion forming a free end external to said cap member wherein said actuator portion is cylindrical in form and is engagable by human fingers to impart axial force thereto; and wherein said stem member comprises a smooth surfaced cylinder of metallic composition having a first end portion engaging said applicator, a centrally disposed portion having an internal elongate cylinder cavity open at an end thereof, a plurality of latch engaging slots formed exteriorly and partially penetrating walls thereof wherein each slot has a step and flat landing formed therein, and a second end portion having a circumferential ridge formed thereon wherein said ridge engages said spring member.

* * * * *